US011096546B2

(12) United States Patent
Ting

(10) Patent No.: US 11,096,546 B2
(45) Date of Patent: Aug. 24, 2021

(54) MOP HEAD

(71) Applicant: Ming-Che Ting, Taoyuan (TW)

(72) Inventor: Ming-Che Ting, Taoyuan (TW)

( * ) Notice: Subject to any disclaimer, the term of this patent is extended or adjusted under 35 U.S.C. 154(b) by 222 days.

(21) Appl. No.: 16/563,802

(22) Filed: Sep. 6, 2019

(65) Prior Publication Data

US 2020/0281435 A1 Sep. 10, 2020

(30) Foreign Application Priority Data

Mar. 6, 2019 (TW) ..... 108107474

(51) Int. Cl.
*A47L 13/20* (2006.01)
*A47L 13/255* (2006.01)
*A47L 13/258* (2006.01)

(52) U.S. Cl.
CPC ..... *A47L 13/255* (2013.01); *A47L 13/258* (2013.01)

(58) Field of Classification Search
CPC ..... A47L 13/24; A47L 13/255; A47L 13/254; A47L 13/258; A46D 3/002
See application file for complete search history.

(56) References Cited

U.S. PATENT DOCUMENTS

2011/0154603 A1* 6/2011 Chen ..... A47L 13/255 15/229.1

FOREIGN PATENT DOCUMENTS

| | | | | |
|---|---|---|---|---|
| TW | 201416045 A | * | 5/2014 | ..... A47L 13/24 |
| TW | 201424664 A | | 7/2014 | |
| TW | I622375 B | | 5/2018 | |
| TW | M565545 | | 8/2018 | |
| WO | 2006/028807 A2 | | 3/2006 | |
| WO | 2015/003419 A1 | | 1/2015 | |

* cited by examiner

*Primary Examiner* — Shay Karls
(74) *Attorney, Agent, or Firm* — AEON Law, PLLC; Adam L. K. Philipp; Jonathan E. Olson

(57) ABSTRACT

The present invention provides a mop head comprising: a mop head frame formed with a plurality of concave connecting portion, a narrow connecting portion of each concave connecting portion includes a first set of protruding elements, a first hollow portion, a second set of protruding elements and a second hollow portion; and a cleaning member. The first set of protruding elements and second set of protruding elements of the narrow connecting portion clamp the cleaning member. The first hollow portion and the second hollow portion provide space that allows the cleaning member be firmly punched in concave connecting portion without damaging the narrow connecting portion by a punch.

10 Claims, 9 Drawing Sheets

MOP HEAD

TECHNICAL FIELD

The present invention relates to a mop head, and more particularly to a mop head with an upper-hole-free concave connecting portion capable of being tightly connected with a cleaning member.

BACKGROUND

Recently, a flat mop has been popular since the flat mop is with merit of low height mop head for deeper cleaning and of occupying space saving. In addition, the mop strips, i.e., cotton strips, of the flat mop could effective and convenient work for cleaning since the flat mop itself could be cleaned in a folded condition. Therefore, the flat mop is with merit in cleaning and storing effect. However, with the popularity of the flat mop, the advanced assembling method for assembling the mop strips on the flat mop head is required.

One kind of prior known flat mops is a mop head providing with a plurality of through holes, i.e., a connecting portion having a top opening and a bottom opening. In its assembling method for assembling the mop strips on the flat mop head, a punch is applied to punch the mop strip through connecting through hole in a vertical direction in such a manner that the portion of the mop strips pushed against by the punch, which is taken as a punch-in portion, is punched from the bottom opening of the connecting through hole and pass through a middle friction part of the connecting through hole until the punch-in portion is exposed outside the top opening of the connecting through hole, and thereafter a volume of the exposed punch-in portion expands and the punch-in portion is then pulled back to pass through the middle friction part to thus get the middle portion of the mop strip stuck by the middle friction part of the through hole. In one another assembling method thereof, the exposed punch-in portion is covered on the top opening of the connecting through hole after the above assembly.

However, the above flat mop providing with connecting through holes in the vertical direction is with a shortcoming of accumulating dust, dirt or hair after being frequently used, especially accumulated in the gap between the exposed punch-in portion and the top opening of the connecting through holes. It thus is not only unaesthetic but is with flaw that the dust, dirt or hair may be detached from the gap while cleaning, or the dust, dirt or hair may drop to a dewater tank while the mop head is in rotation cleaning. All of the above are required to be overcome.

Accordingly, a solution for the above is a mop head frame having a concave connecting portion with only a bottom opening but is not with an upper opening. However, such concave connecting portion of map head frame without the upper opening faces a problem that it is difficult to firmly stick the cleaning member to the mop head frame in the assembly. The reason is that, upon the requirement that the cleaning member needs to get stuck by the middle friction part of the concave connecting portion, a punch is difficult not to destroy the structure of the middle friction part when the punch is pulled back and exits from of the concave connecting portion. The problem is an issue to be solved.

SUMMARY

Accordingly, an objective of the present invention is to provide a structure of concave connecting portion with only a bottom opening but is not with a upper opening for a flat mop head frame of a mop head, by which the cleaning member could be firmly connected to the concave connecting portion.

To solve the issues above, the present invention provides a mop head, comprising: a mop head frame, which is formed by injection molding through a mold, the mold has a plurality of protruding portion by which a plurality of concave connecting portions are formed on a bottom surface of the mop head frame, each concave connecting portion includes a bottom opening, a closed roof portion, a side wall and a narrow connecting portion, wherein an upper surface of the mop head frame seals the mop head frame to form the closed roof portion, the side wall is disposed between the bottom opening and the closed roof portion, the narrow connecting portion includes a first set of protruding elements, a first hollow portion, a second set of protruding elements and a second hollow portion in such a manner that, in sequence, the first set of protruding elements, the first hollow portion, the second set of protruding elements and the second hollow portion surround the side wall thereby enabling the first set of protruding elements and the second set of protruding elements, which are formed by injection molding to extend from the side wall toward a vertical axis of the concave connecting portion such that the first hollow portion is a hollow space neighboring between one side edge of the first set of protruding elements and one side edge of the second set of protruding elements, the second hollow portion is a hollow space neighboring between another side edge of the first set of protruding elements and another side edge of the second set of protruding elements, in which the first hollow portion is disposed opposite to the second hollow portion, and a concave accommodating portion is formed between the closed roof portion and the narrow connecting portion, wherein after the injection molding, the protruding portion presses against and passes through the first set of protruding elements and the second set of protruding elements to compulsively demold from the concave connecting portion, and a cleaning member having a punch-in portion, a squeeze-in portion and a non-squeeze-in portion, wherein a I-shaped punch presses the punch-in portion to enable the I-shaped punch with the width and thickness to pass through the first hollow portion and the second hollow portion such that the punch-in portion and the squeeze-in portion are squeezed into the concave accommodating portion, and then the I-shaped punch moves in an opposite direction to pass through the first hollow portion and the second hollow portion to draw back from the concave connecting portion.

According to one embodiment of the present invention, a first hollow width of the first hollow portion in the side wall and a second hollow width of the second hollow portion in the side wall are both larger than a spacing width between two neighboring angular protruding elements which respectively belongs to the first set of protruding elements or the second set of protruding elements.

According to one embodiment of the present invention, the first set of protruding elements is a plurality of neighboring angular protruding elements, and the second set of protruding elements is a plurality of neighboring angular protruding elements, and the plurality of angular protruding element are neighboring formed to surround the side wall.

According to one embodiment of the present invention, two sides, in a radial direction, of the bottom opening of the first hollow portion are parallel to two sides, in a radial direction, of the bottom opening of the second hollow portion.

According to one embodiment of the present invention, the first set of protruding elements are a plurality of protruding elements with a continuous thickness in a radial direction of a bottom opening, the second set of protruding elements are a plurality of protruding elements with a continuous thickness in a radial direction of a bottom opening.

According to one embodiment of the present invention, a buffering distance is formed, in an axial direction of the bottom opening, between the bottom opening and the first set of protruding elements and between the bottom opening and the second set of protruding elements.

The structure of the present invention enables, upon the cleaning member 2 to be stuck in the narrow connecting portion 15 of the concave connecting portion 11, the punch to exit from the concave connecting portion 11 without damaging the narrow connecting portion 15, as shown in FIG. 2. As shown in FIG. 6, in the present invention, a force, applying to the punch P for enabling the punch P to punch the cleaning member 2 to the concave connecting portion 11, could be less. Similarly, a force, applying to the punch P for enabling the punch P to exit from the concave connecting portion 11 without affecting the connection between the cleaning member 2 and the narrow connecting portion 15, could also be less.

DETAILED DESCRIPTION OF THE PREFERRED EMBODIMENTS

The preferred embodiments of the present invention are described in detail below with reference to FIG. 1 to FIG. 8. The description is used for explaining the embodiments of the present invention only, but not for limiting the scope of the claims.

Figure 1:
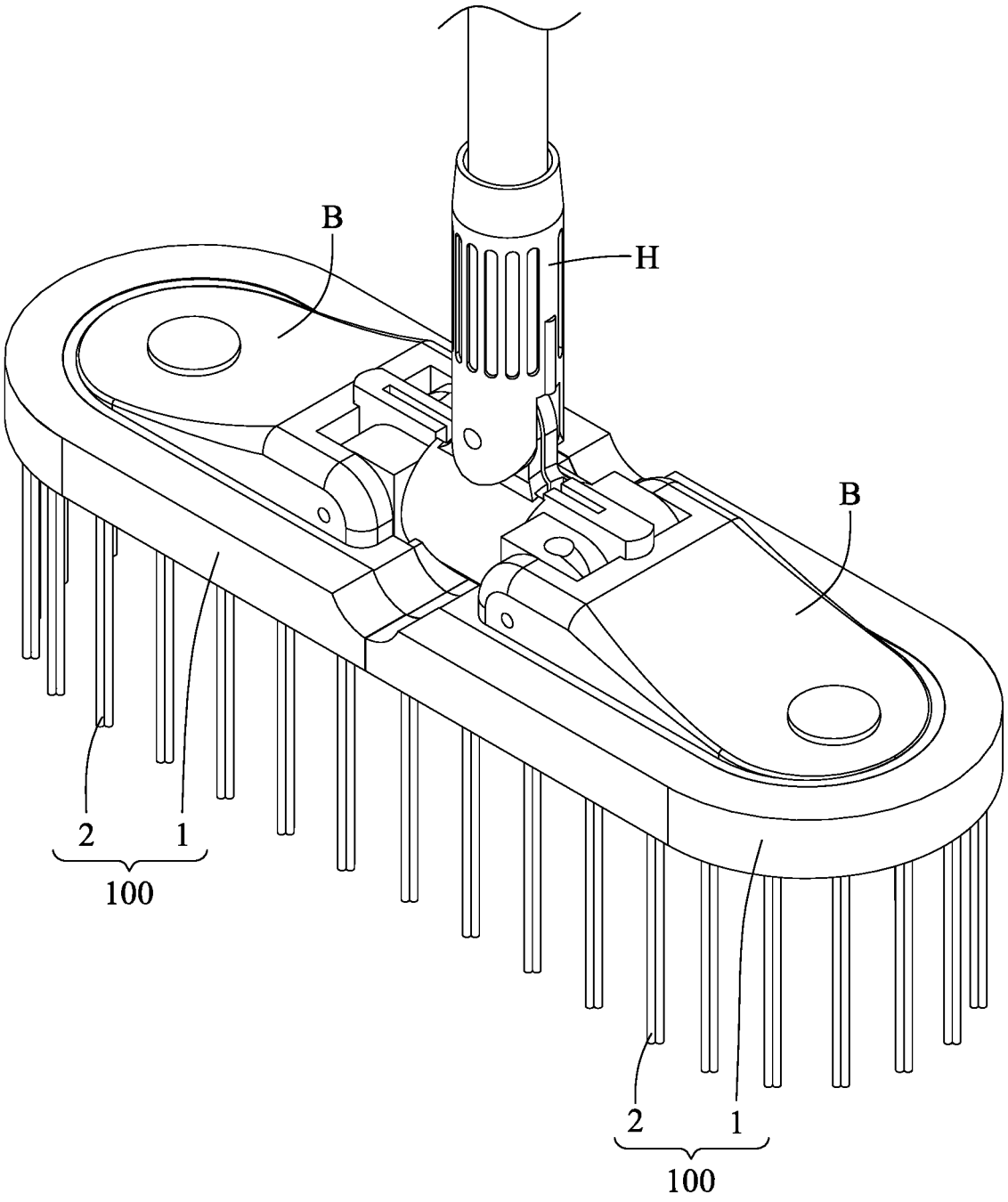
FIG. 1 illustrates a schematic diagram of a mop head mounting on a mop according to a first embodiment of the present invention.
Figure 3:
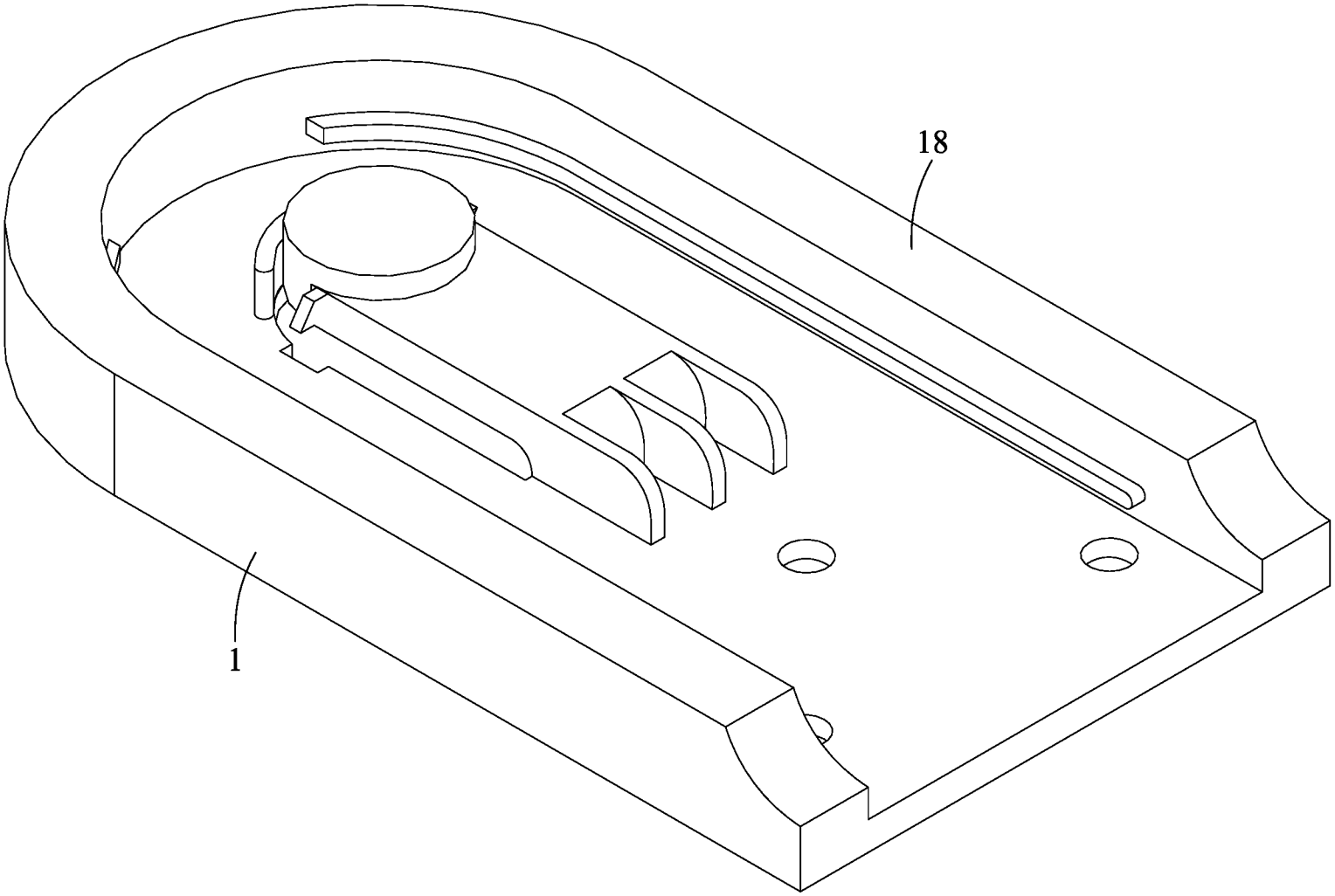
FIG. 3 illustrates a top view of a schematic diagram of the mop head frame of the mop head according to the embodiment of the present invention.

FIG. 1 illustrates a mop base B, a mop handle H and a mop head 100 according to one embodiment of the present invention. The mop head 100 comprises: a mop head frame 1 and a cleaning member 2. Specifically, for each of two mop heads 100 of the present invention, an upper portion of the mop head frame 1, as shown in FIG. 3, is detachably mounted at a side portion and a bottom portion of the mop base B. In FIG. 1, both of the two mop heads are assembled with the mop bases. The mop base B is connected to the mop handle H to allow the floor mopping. In the present embodiment, the cleaning member 2 can be cotton strips. However, the embodiments are not limit to this.

Figure 2:
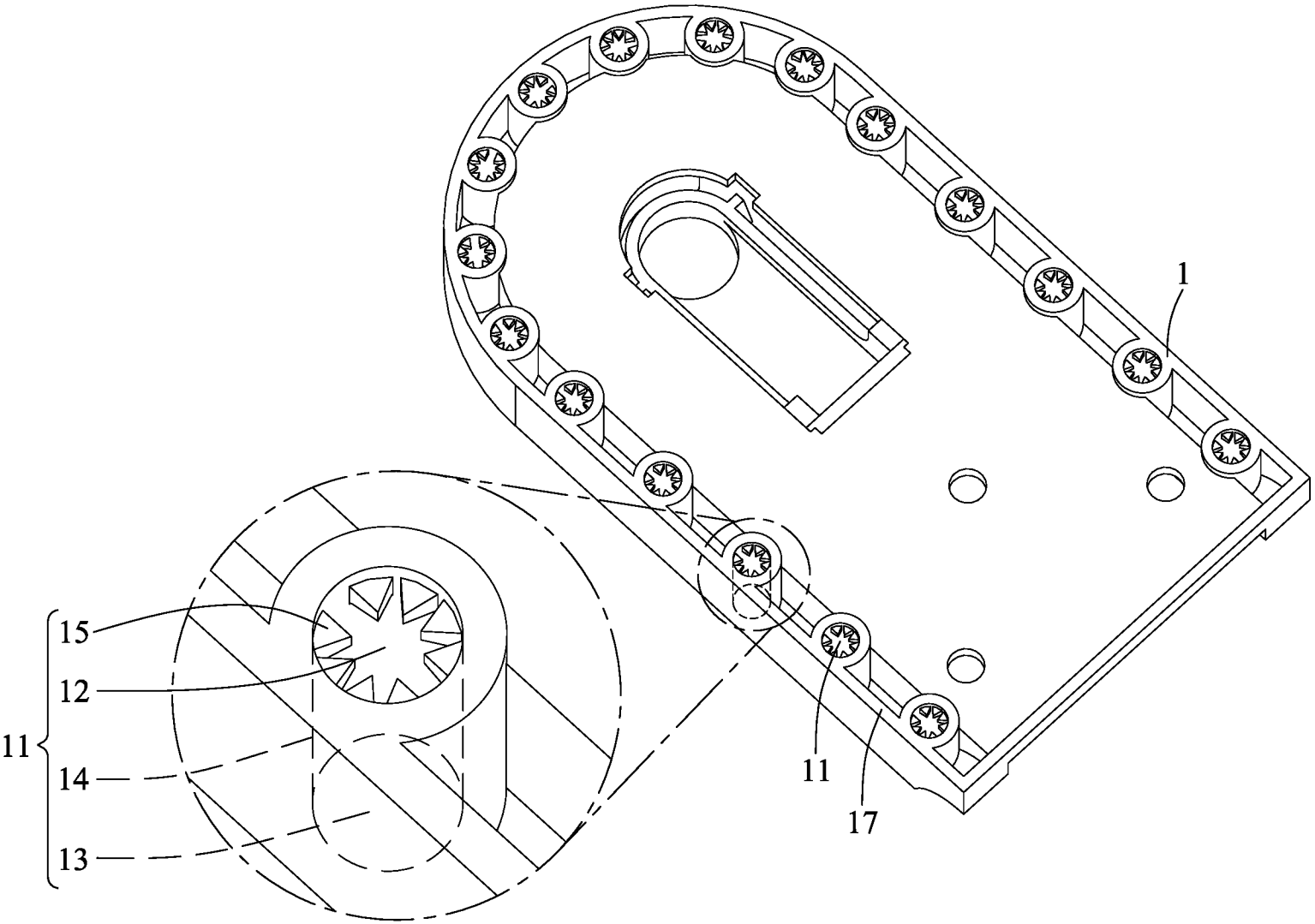
FIG. 2 illustrates a bottom view of a schematic diagram of a mop head frame of the mop head according to the embodiment of the present invention.

FIG. 2 illustrates a bottom view of a schematic diagram of a mop head frame 1 of the mop head 100 according to one embodiment of the present invention. A bottom surface 17 of the mop head 100 is formed with a plurality of concave connecting portion 11. Each of the concave connecting portions 11 comprises a bottom opening 12, closed roof portion 13, side wall 14 and narrow connecting portion 15. An end of the closed roof portion 13 is sealed by an upper surface 18 of the mop head frame 1. The side wall 14 is disposed between the bottom opening 12 and the closed roof portion 13. In other word, the concave connecting portion 11 is a recess formed on the bottom surface 17 of the mop head frame 1. The recess has a bottom opening 12 as its opening and is sealed by the upper surface 18 of the mop head frame 1 as shown in FIG. 3. The side wall 14 of the concave connecting portion 11 is a cylindrical wall surface. FIG. 3 is a schematic diagram of the mop head frame 1 of the mop head 100 according to one embodiment of the present invention. The upper surface shown in the FIG. 3 is provided to connect with the mop base B as shown in FIG. 1.

Figure 4A:
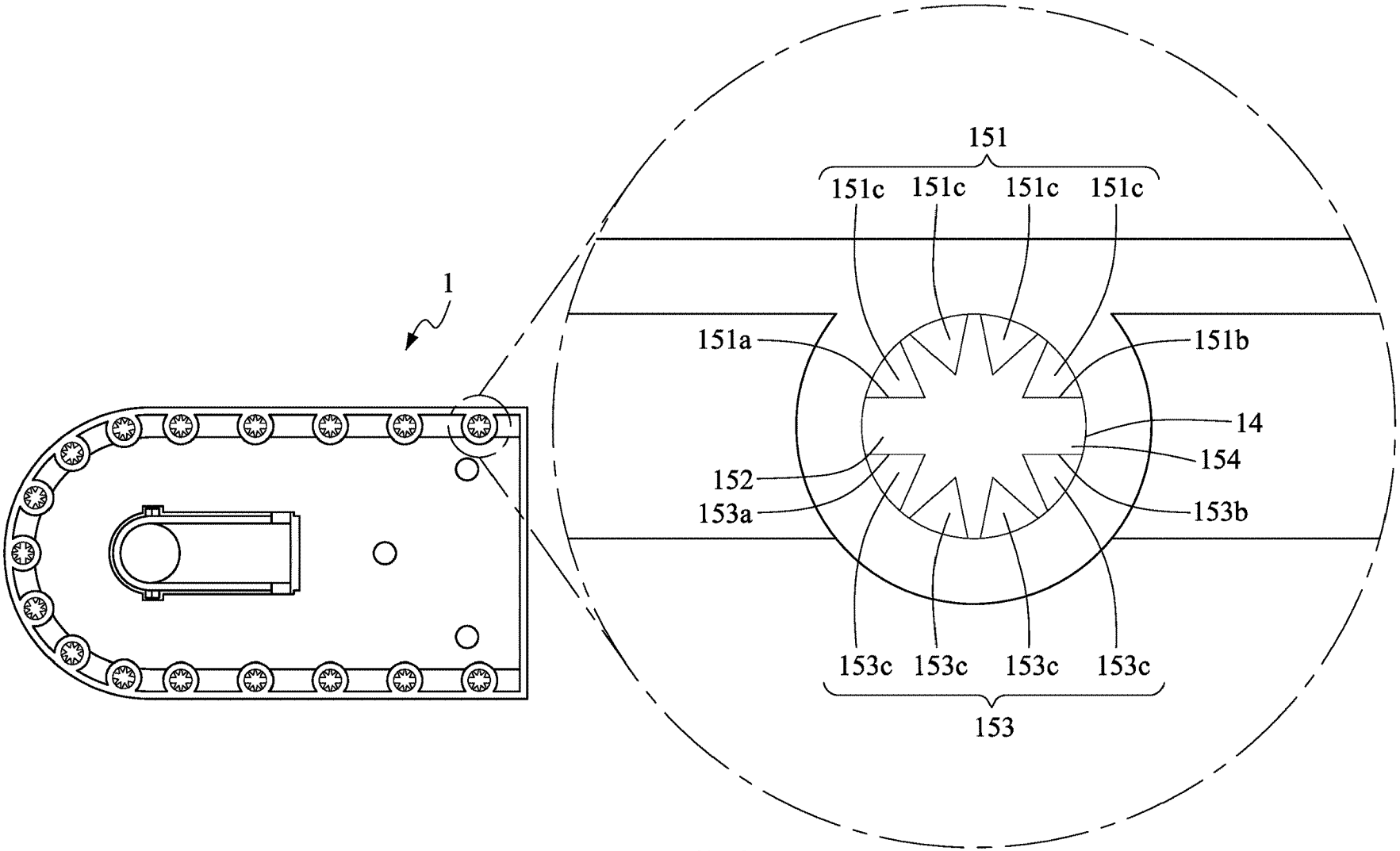
FIG. 4*a* illustrates a bottom view of the mop head frame of the mop head according to the embodiment of the present invention.
Figure 5:
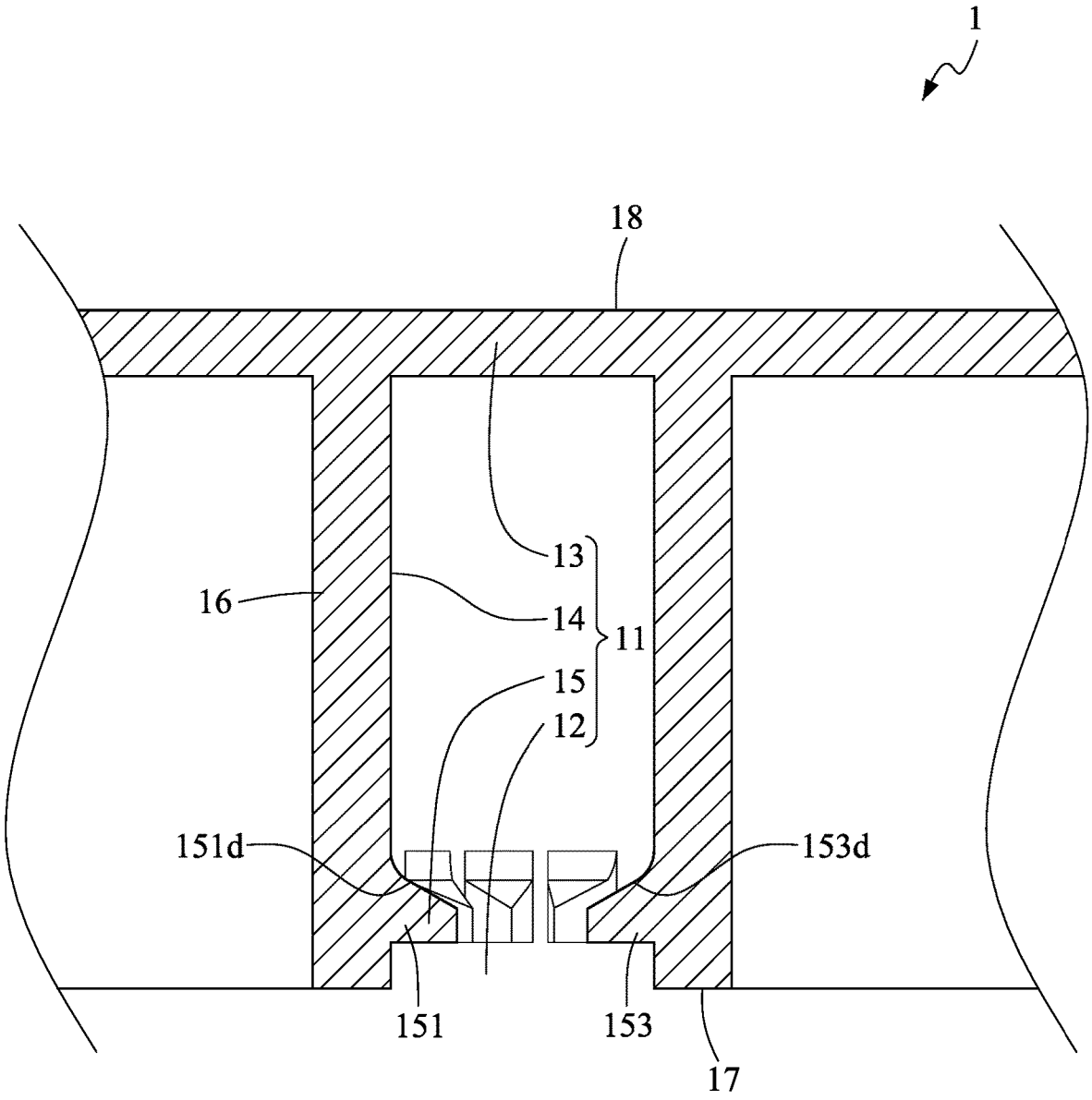
FIG. 5 illustrates a side sectional view of the mop head frame of the mop head according to the embodiment of the present invention.
Figure 8:
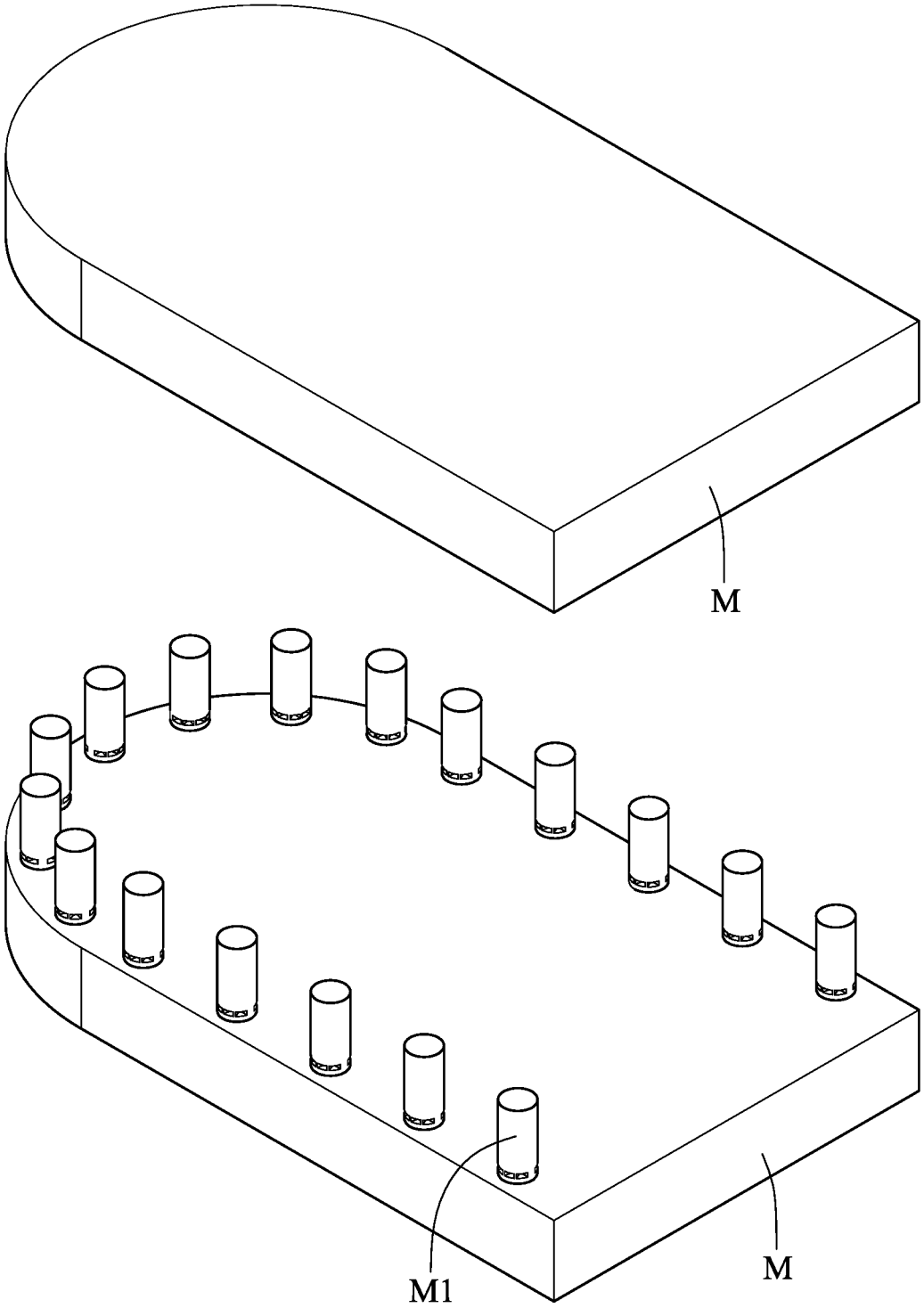
FIG. 8 illustrates a schematic diagram of molds which forms the mop head according to the embodiment of the present invention.

As shown in FIG. 4*a*, the narrow connecting portion 15 has a first set of protruding elements 151, a first hollow portion 152, a second set of protruding elements 153 and a second hollow portion 154 in such a manner that, in sequence, the first set of protruding elements 151, the first hollow portion 152, the second set of protruding elements 153 and the second hollow portion 154 surround the side wall 14, as also shown in FIG. 2. As shown in FIG. 4*a*, the first set of protruding elements 151 and the second set of protruding elements 153 are formed by injection molding to thus extend from the side wall 14 toward a vertical axis of the concave connecting portion 11. The first hollow portion 152 is a hollow space neighboring between one side edge 151*a* of the first set of protruding elements 151 and one side edge 153*a* of the second set of protruding elements 153. The second hollow portion 154 is a hollow space neighboring between another side edge 151*b* of the first set of protruding elements 151 and another side edge 153*b* of the second set of protruding elements 153. The first hollow portion 152 is disposed opposite to the second hollow portion 154. As shown in FIG. 5, a concave accommodating portion 16 is formed between the closed roof portion 13 and the narrow connecting portion 15. The forming method of the concave connecting portion 11, which has the bottom opening 12, the closed roof portion 13, the side wall 14 and the narrow connecting portion 15, is achieved as follows and is shown in FIG. 8. Two molds M approach to each other. One of the molds has protruding portions M1 and another mold M has corresponding recesses (not shown) corresponding to the protruding portions M1. An outer surface of the protruding portion M1 forms a surface of the concave accommodating portion 16. Two molds M approach to each other in such a manner that the protruding portions M1 of a mold M protrudes into the corresponding recesses of another mold M. And then the injection molding is performed between the two molds to form the first set of protruding elements 151 and the second set of protruding elements 153. After the injection molding, the protruding portions M1 are pulled back from the corresponding recesses. Through the pulling back operation, each protruding portion M1 is changed from being inserted by the first set of protruding elements 151 and the second set of protruding elements 153 to enable the first set of protruding elements 151 and the second set of protruding elements 153 to detach away from inserting into the protruding portion M1, and thus the first set of protruding elements 151 and the second set of protruding elements 153 are compulsively demolded from the protruding portion M1.

Figure 4B:
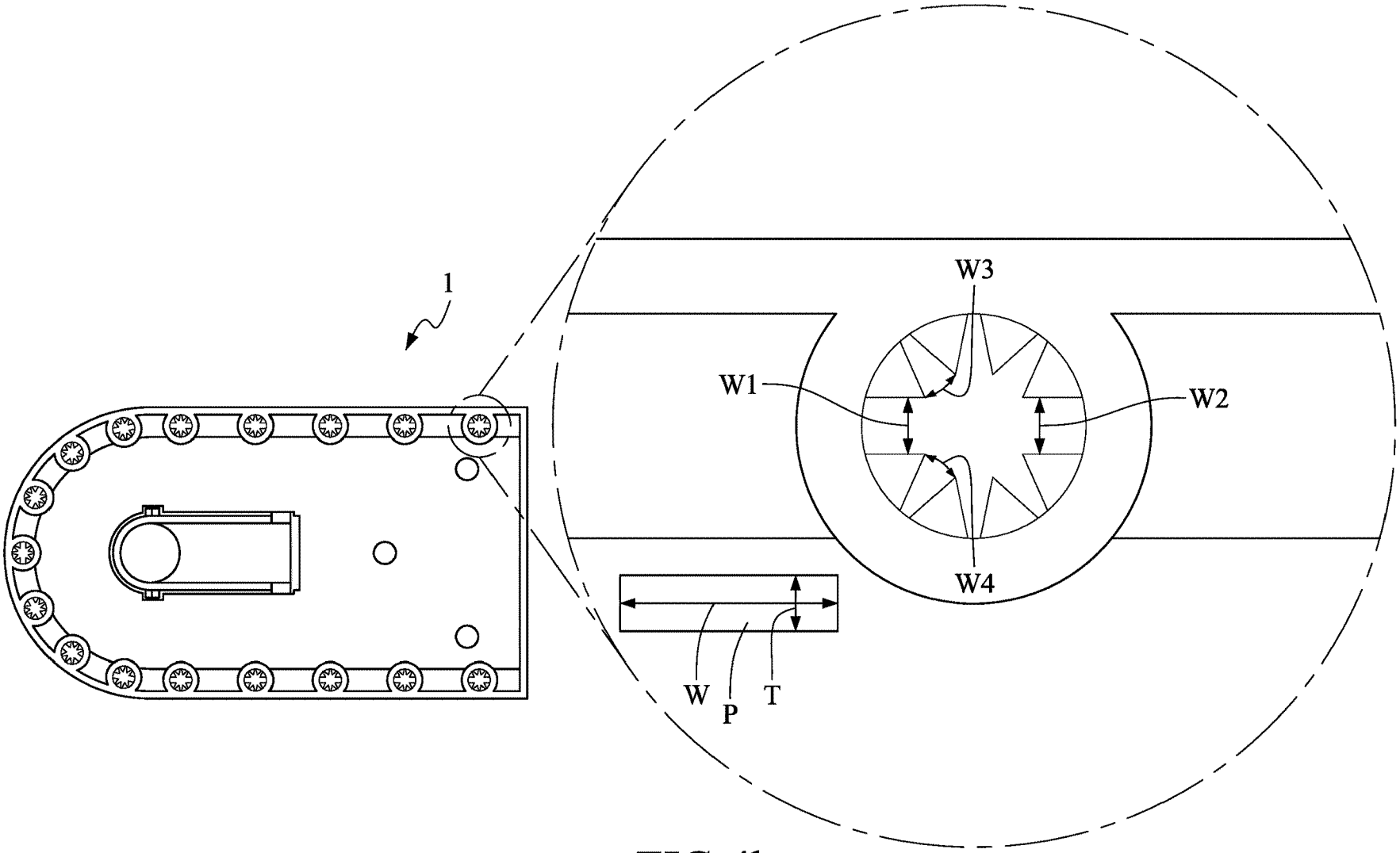
FIG. 4*b* illustrates a bottom view of a comparison of the size of the mop head and the size of the punch.

In FIG. 4*b*, the mop head 100, according to one embodiment of the present invention, a first hollow width W1 of the first hollow portion 152 on the side wall 14 and a second hollow width W2 of the second hollow portion 154 on the side wall 14 are both larger than a spacing width W3, W4 between two neighboring angular protruding elements 151*c*, 153*c*, which respectively belong to the first set of protruding elements 151 or the second set of protruding elements 153.

Figure 6:
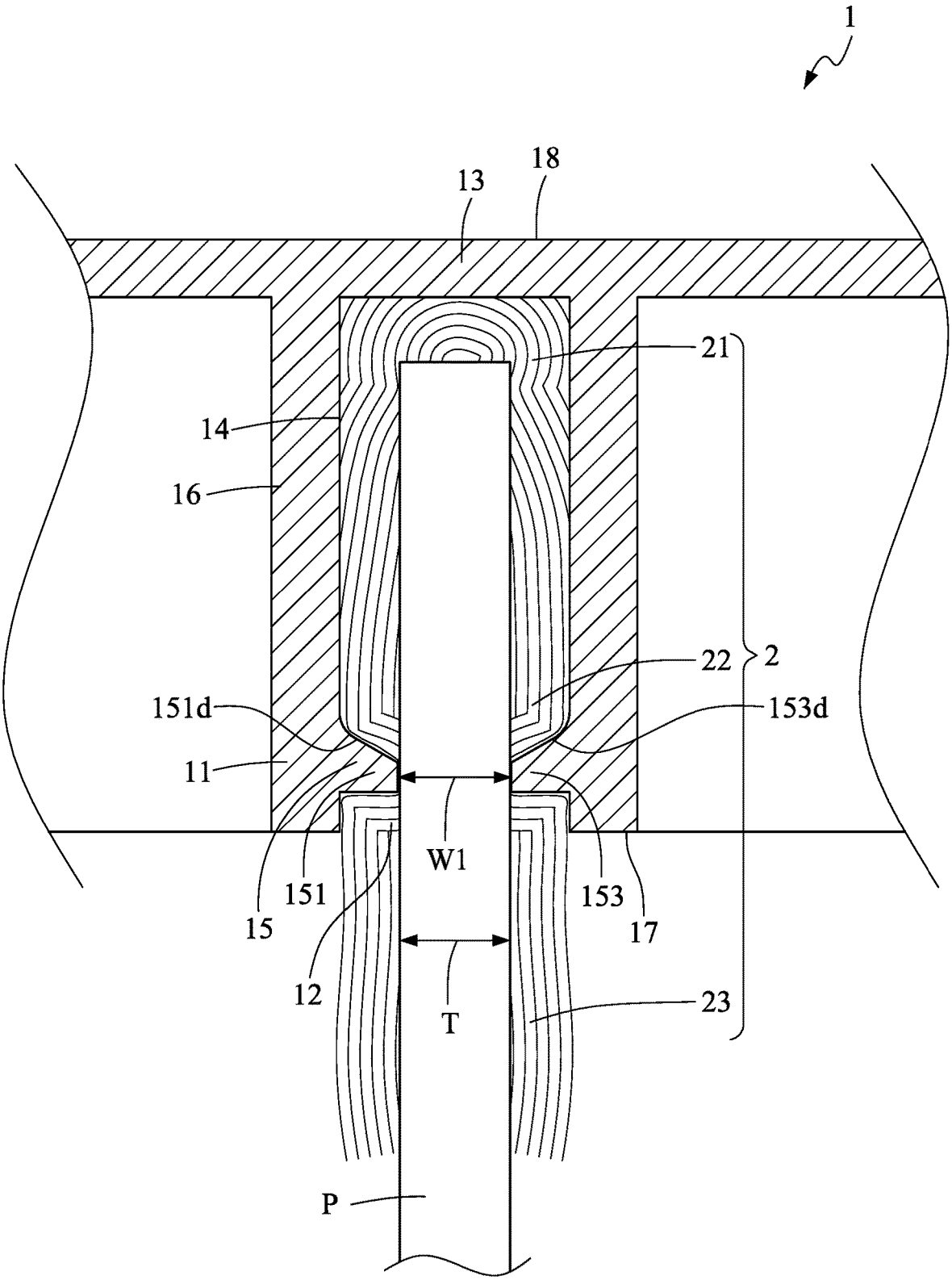
FIG. 6 illustrates a side sectional view of a cleaning member being punched into a concave connecting portion by an I-shaped punch according to the embodiment of the present invention.

As shown in FIG. 4*a*, FIG. 4*b* and FIG. 6, the first hollow width W1 is equal to the second hollow width W2. The end of punch P is in I-shaped form whose width W is larger than thickness T. In another embodiment, the first hollow width W1 and the second hollow width W2 are equal to or larger than the thickness T of the fitting I-shaped punch P. A diameter of the side wall 14 is equal to or larger than the width W of the I-shaped punch P.

In the mop head 100 according to the embodiment of the present invention as shown in FIG. 4*a*, 4*b* and FIG. 6, the first set of protruding elements 151 is formed with four neighboring angular protruding elements 151*c*. Each angular protruding element 151*c* is annularly disposed in adjacent on the side wall 14. And the second set of protruding elements 153 is formed with four neighboring angular protruding elements 153*c*. Each angular protruding element 153*c* is annularly disposed in adjacent on the side wall 14. Each angular protruding element 151*c*, 153*c* is formed with an acute angle to pierce into the cleaning member 2 easily so as to stabilize the cleaning member 2. In other embodiments, the first set of protruding elements 151 and the second set of protruding elements 153 respectively have at least two angular protruding elements 151*c*, 153*c*.

In the mop head 100 according to the embodiment of the present invention as shown in FIG. 4*a* and FIG. 4*b*, a lower side of the bottom opening 12 of the first hollow portion 152 is parallel to a lower side of the bottom opening 12 of the second hollow portion 154. A higher side of the bottom opening 12 of the first hollow portion 152 is parallel to a higher side of the bottom opening 12 of the second hollow portion 154. As shown in FIG. 5, a buffering distance is formed, in an axial direction of the bottom opening 12, between the bottom opening 12 and the first set of protruding elements 151 and between the bottom opening 12 and the second set of protruding elements 153. Thus when the protruding portion M1 is pulled back from the corresponding concave accommodating portion 16, the first set of protruding elements 151 and the second set of protruding elements 153 would not be separated from the side wall 14.

In the mop head 100 according to the embodiment of the present invention as shown in FIG. 2, FIG. 4*a*, FIG. 4*b* and FIG. 5, the first set of protruding elements 151 are a plurality of protruding elements. Each protruding element is with a gradient descent thickness in a radial direction of the bottom opening. The second set of protruding elements 153 are a plurality of protruding elements. Each protruding element is with a gradient descent thickness in a radial direction of a bottom opening 12. In detail, the thickness of the protruding elements of the first set of protruding elements 151, i.e. the angular protruding element 151*c*, and the thickness of the second set of protruding elements 153, i.e. the angular protruding element 153*c*, are gradient descent from the side wall 14 to the center. In addition, inner wall surfaces 151*d* of the first set of protruding elements 151 and inner wall surfaces 153*d* of the second set of protruding elements 153 are formed declined from the side wall 14 toward the center to facilitate the compulsive demolding for the mold M.

Figure 7:
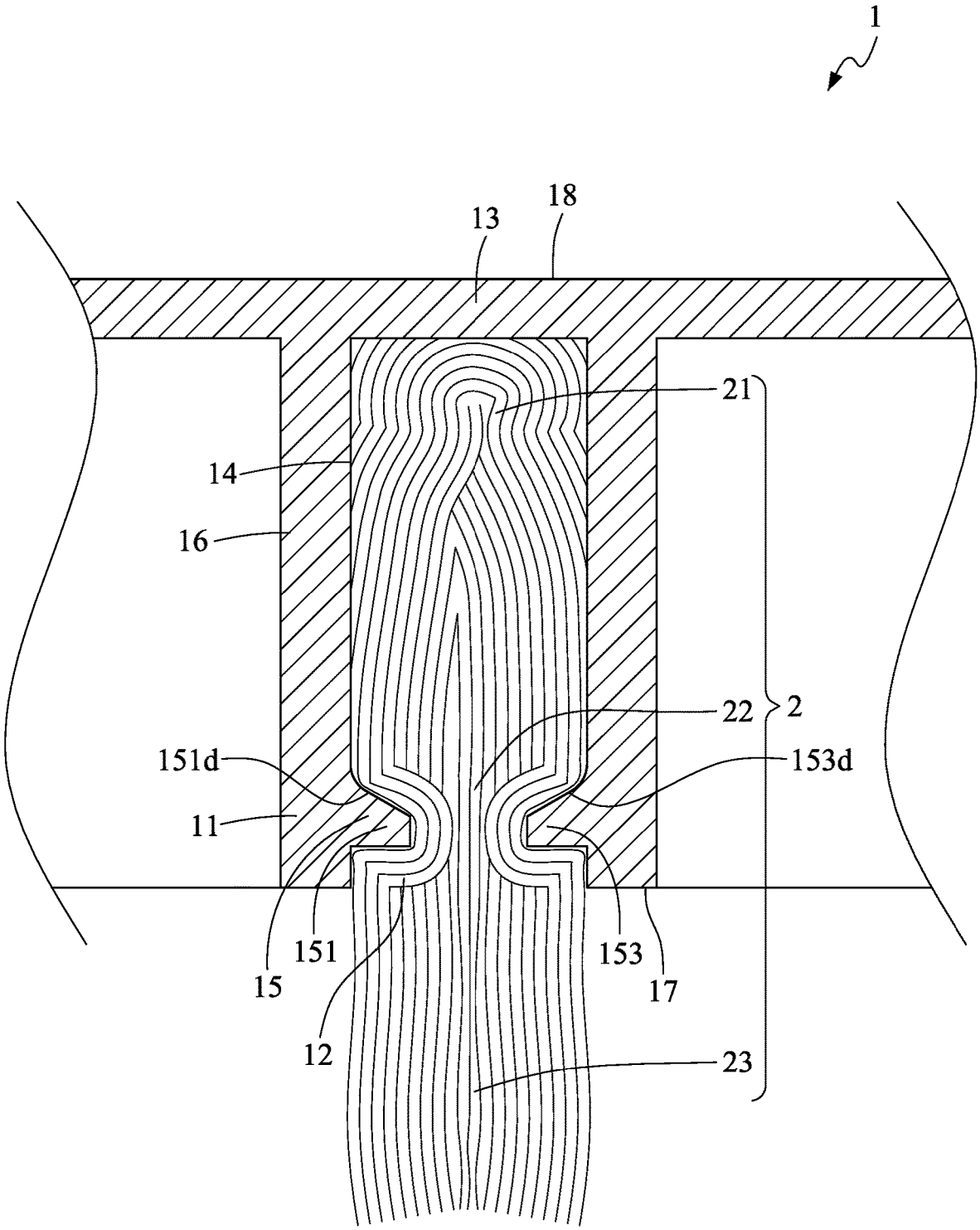
FIG. 7 illustrates a side sectional view of the mop head according to the embodiment of the present invention.

As shown in FIG. 6 and FIG. 7, the cleaning member 2 has a punch-in portion 21, a squeeze-in portion 22 and a non-squeeze-in portion 23. An I-shaped punch P presses the punch-in portion 21 to enable the I-shaped punch P with the width W and thickness T to pass through the first hollow portion 152 and the second hollow portion 154 such that the punch-in portion 21 and the squeeze-in portion 22 are squeezed into the concave accommodating portion 16, and then the I-shaped punch P is pulled back to move in an opposite direction to pass through the first hollow portion 152 and the second hollow portion 154 to draw back from the concave connecting portion 11.

FIG. 6 and FIG. 7 show strips of the cleaning member 2 are inserted. The first set of protruding elements 151 and the second set of protruding elements 153 of the narrow connecting portion 15 clamp the cleaning member 2. The bent portion of the strip is a punch-in portion 21. A portion of the strip in the concave accommodating portion 16 is a squeeze-in portion 22. A portion exposed outside the concave accommodating portion 16 is a non-squeeze-in portion 23 which is for cleaning purpose. The present invention is not limited to this. One or a plurality of strip can be squeezed in one concave accommodating portion 16.

The mop head frame 1 is formed by injection molding through a mold M. FIG. 7 illustrates the molds for forming the mop head 100 of the present invention. The mold M has a plurality of protruding portion M1 by which a plurality of concave connecting portions 11 are formed on a bottom surface 17 of the mop head frame 1. The shape of recesses at the bottom of the protruding portions M1 corresponds to the shape of the angular protruding elements 151*c* of the first set of protruding elements 151 and the angular protruding elements 153*c* of the second set of protruding elements 153.

The above description should be considered as only the discussion of the preferred embodiments of the present invention. A person having ordinary skill in the art may make various modifications to the present invention. However, those modifications still fall within the spirit of the present invention and the scope defined by the appended claims.

What is claimed is:

1. A mop head, comprising:

a mop head frame, which is formed by injection molding through a mold, the mold has a plurality of protruding portion by which a plurality of concave connecting portions are formed on a bottom surface of the mop head frame, each concave connecting portion includes a bottom opening, a closed roof portion, a side wall and a narrow connecting portion, wherein an upper surface of the mop head frame seals the mop head frame to form the closed roof portion, the side wall is disposed between the bottom opening and the closed roof portion, the narrow connecting portion includes a first set of protruding elements, a first hollow portion, a second set of protruding elements and a second hollow portion in such a manner that, in sequence, the first set of protruding elements, the first hollow portion, the second set of protruding elements and the second hollow portion surround the side wall thereby enabling the first set of protruding elements and the second set of protruding elements, which are formed by injection molding to extend from the side wall toward a vertical axis of the concave connecting portion such that the first hollow portion is a hollow space neighboring between one side edge of the first set of protruding elements and one side edge of the second set of protruding elements, the second hollow portion is a hollow space neighboring between another side edge of the first set of protruding elements and another side edge of the second set of protruding elements, in which the first hollow portion is disposed opposite to the second hollow portion, and a concave accommodating portion is formed between the closed roof portion and the narrow connecting portion, wherein after the injection molding, the protruding portion presses against and passes through the first set of protruding elements and the second set of protruding elements to compulsively demold from the concave connecting portion, and a cleaning member having a punch-in portion, a squeeze-in portion and a non-squeeze-in portion, wherein a I-shaped punch presses the punch-in portion to enable the I-shaped punch with the width and thickness to pass through the first hollow portion and the second hollow portion such that the punch-in portion and the squeeze-in portion are squeezed into the concave accommodating portion, and then the I-shaped punch moves in an opposite direction to pass through the first hollow portion and the second hollow portion to draw back from the concave connecting portion.

2. The mop head as claimed in claim 1, wherein a first hollow width of the first hollow portion in the side wall and a second hollow width of the second hollow portion in the side wall are both larger than a spacing width between two neighboring angular protruding elements which respectively belongs to the first set of protruding elements or the second set of protruding elements.

3. The mop head as claimed in claim 2, wherein the first set of protruding elements is a plurality of neighboring angular protruding elements, and the second set of protruding elements is a plurality of neighboring angular protruding elements, and the plurality of angular protruding element are neighboring formed to surround the side wall.

4. The mop head as claimed in claim 2, wherein two sides, in a radial direction, of the bottom opening of the first hollow portion are parallel to two sides, in a radial direction, of the bottom opening of the second hollow portion.

5. The mop head as claimed in claim 2, wherein the first set of protruding elements are a plurality of protruding elements with a continuous thickness in a radial direction of a bottom opening, the second set of protruding elements are a plurality of protruding elements with a continuous thickness in a radial direction of a bottom opening.

6. The mop head as claimed in claim 2, wherein a buffering distance is formed, in an axial direction of the bottom opening, between the bottom opening and the first set of protruding elements and between the bottom opening and the second set of protruding elements.

7. The mop head as claimed in claim 1, wherein the first set of protruding elements is a plurality of neighboring angular protruding elements, and the second set of protruding elements is a plurality of neighboring angular protruding elements, and the plurality of angular protruding element are neighboring formed to surround the side wall.

8. The mop head as claimed in claim 1, wherein two sides, in a radial direction, of the bottom opening of the first hollow portion are parallel to two sides, in a radial direction, of the bottom opening of the second hollow portion.

9. The mop head as claimed in claim 1, wherein the first set of protruding elements are a plurality of protruding elements with a continuous thickness in a radial direction of a bottom opening, the second set of protruding elements are a plurality of protruding elements with a continuous thickness in a radial direction of a bottom opening.

10. The mop head as claimed in claim 1, wherein a buffering distance is formed, in an axial direction of the bottom opening, between the bottom opening and the first set of protruding elements and between the bottom opening and the second set of protruding elements.

* * * * *